United States Patent [19]

Devine

[11] Patent Number: 4,653,609

[45] Date of Patent: Mar. 31, 1987

[54] CONTROLLED DESCENT APPARATUS

[76] Inventor: Millard J. Devine, c/o Fids, Inc., 210 Hollister Ave., Rockford, Ill. 61108

[21] Appl. No.: 676,790

[22] Filed: Nov. 30, 1984

[51] Int. Cl.[4] ..... A62B 1/12

[52] U.S. Cl. ..... 182/238; 182/239; 182/71; 182/233; 182/234

[58] Field of Search ..... 182/235, 231–233, 182/5–7, 70, 73, 236–240, 71, 72, 234, 238, 239

[56] References Cited

U.S. PATENT DOCUMENTS

| | | | |
|---|---|---|---|
| 287,492 | 10/1883 | Woodward | 187/235 |
| 526,385 | 9/1894 | Dymacek | 182/238 |
| 652,247 | 6/1900 | Christ . | |
| 701,094 | 5/1902 | Setbacker | 182/239 |
| 3,834,671 | 9/1974 | Du Mesnil du Buisson | 254/158 |
| 3,844,377 | 10/1974 | Wilkins | 182/73 |
| 3,861,496 | 1/1975 | Hoover | 182/5 |
| 3,879,016 | 4/1975 | Kankkunen | 254/158 |
| 3,880,255 | 4/1975 | Huntly | 182/5 |
| 3,915,432 | 10/1975 | Bustamante | 182/240 |
| 4,018,423 | 4/1977 | Belew | 254/158 |
| 4,026,385 | 5/1977 | Murukurthy | 182/75 |
| 4,442,918 | 4/1984 | Rhoads | 182/238 |
| 4,493,396 | 1/1985 | Borgia | 182/238 |
| 4,520,900 | 6/1985 | Orgeron | 182/238 |

FOREIGN PATENT DOCUMENTS

| | | | |
|---|---|---|---|
| 2326041 | 11/1973 | Fed. Rep. of Germany | 182/239 |
| 2306110 | 8/1974 | Fed. Rep. of Germany | 182/238 |

*Primary Examiner*—Reinaldo P. Machado
*Assistant Examiner*—Alvin Chin-Shue
*Attorney, Agent, or Firm*—Leydig, Voit & Mayer, Ltd.

[57] ABSTRACT

A controlled descent apparatus for lowering a person from an elevated place includes a cable which is wound on a drum and is unwound from the drum by the weight of the person to effect the descent. To limit the rate of descent, the drum turns as the cable is unwound and drives a positive displacement pump the output of which is through a flow control valve. The latter is set to permit a preselected maximum rate of flow so that the drum turns at a correlated maximum speed and thus limits the rate at which the cable is paid out during the descent. In the unlikely event that the valve fails to limit the speed of the drum, a centrifugally operated brake is automatically energized at a somewhat higher speed of the drum whereby the descent continues at a faster but still a safe rate. The cable is guided through an opening, such as a window, in an outside wall by an arm which is formed by inner and outer sections pivotally connected to each other with the inner arm pivotally connected relative to the wall so that the arm may be placed in a compact stored condition. To use the apparatus, the outer arm section first is swung down and latched to the inner arm section in a ready position and then the arm is swung to an active position in which the outer section projects through the window. The apparatus also includes alternative power and manual means to rewind the cable on the drum for the next descent.

14 Claims, 13 Drawing Figures

CONTROLLED DESCENT APPARATUS

BACKGROUND OF THE INVENTION

In case of emergencies such as fire in tall apartment buildings, hotels, office buildings and the like, conventional means of escape such as stairs and ladders may be impractical or impossible to use. This invention relates to an auxiliary apparatus which permits an object, usually a person, to be lowered from an elevated place in such a building at a controlled and safe rate of descent.

SUMMARY OF THE INVENTION

The general object of the invention is to provide a novel controlled descent apparatus which lowers an object at a controlled and safe rate, which is easy to use and relatively inexpensive to manufacture and which is readily stored in a compact condition and out of the way.

A more detailed object is to achieve the foregoing by lowering the object on a cable which is wound on a drum and which turns to unwind the cable under the weight of the object by having the drum drive a positive displacement pump with a flow control valve in the output of the pump to limit the speed of the pump so as to limit the speed of rotation of the drum and hence the rate of descent.

Another object is to employ a friction brake means which is automatically energized at a preselected speed of the drum higher than speed permitted by the flow control valve in the unlikely event that the latter fails and to utilize the brake means to control the descent at a higher but still safe rate.

In another of its aspects, the invention aims to provide a novel arm which may be stored compactly, which is easily moved to an active position in which it projects through an opening in an outside wall of the building and which guides the cable from the drum to the end of the arm outside the building where it supports the object to be lowered.

Still another object is to construct the arm in two parts, that is, inner and outer sections pivotally connected together and the inner section pivotally mounted adjacent the outside wall so that the two sections may be placed in position for compact storage while permitting the sections to be placed quickly and easily in condition to be swung to the active position.

The invention also resides in the novel construction, arrangement and cooperation of the components and parts of the apparatus.

DETAILED DESCRIPTION OF THE PREFERRED EMBODIMENT

Figure 1:
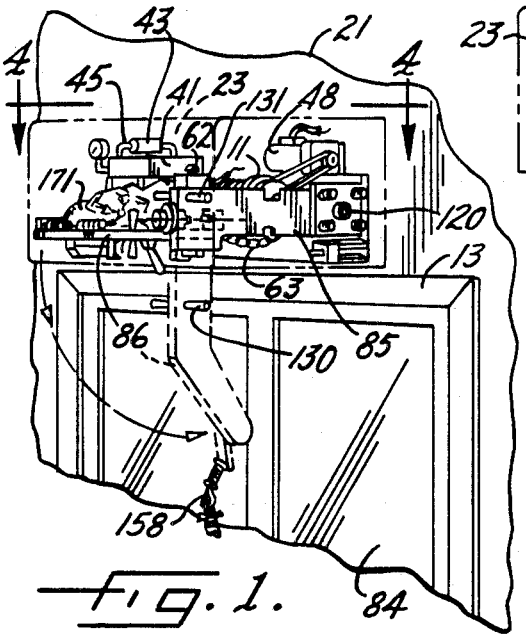
FIG. 1 is a fragmentary perspective view of a controlled descent apparatus embodying my invention as mounted in connection with a window.

As shown in the drawings for purposes of illustration, the invention is embodied in an apparatus for lowering an object, usually a person, from some elevated place in the event of an emergency. For example, in case of fire in a tall apartment building, hotel or office building, the only escape may be through a window and it may be impractical or impossible to use a ladder for this. Accordingly, the present invention contemplates the provision of a novel apparatus by which the person is lowered automatically by gravity by virtue of his own weight and the lowering occurs at a controlled rate of descent. In general, the apparatus includes a cable 10 wound on a drum 11 with the person or object carried by the free end of the cable so that the weight of the person turns the drum and unwinds the cable and a control means limits the rotation of the drum to a preselected maximum speed and thus limits the rate at which the person descends. The invention also contemplates the provision of a novel arm 12 which is stored inside the building but is movable through an opening such as a window 13 to project outside and guide the cable 10 outside for the descent.

Figure 4:
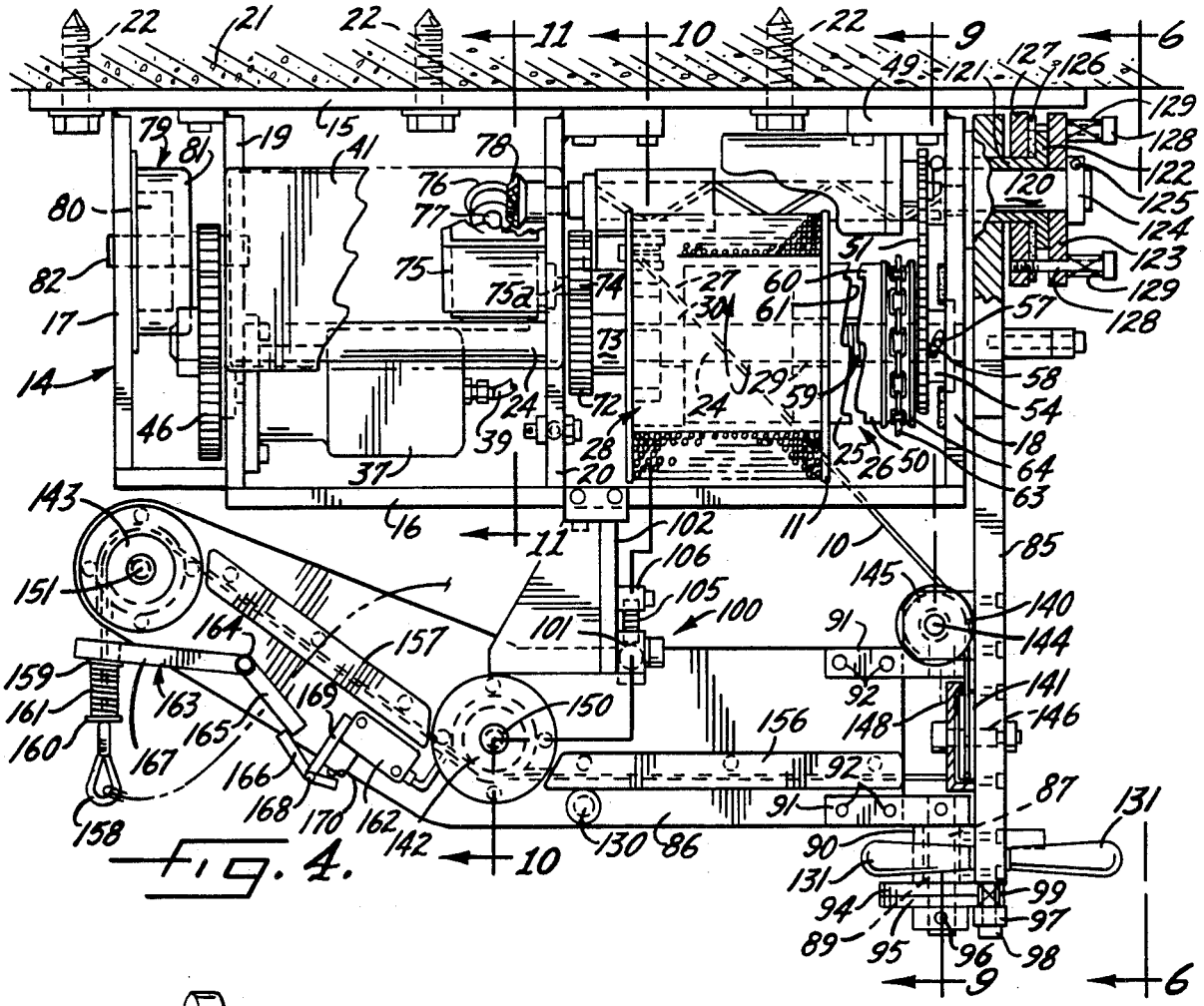
FIG. 4 is an enlarged sectional view taken along the line 4—4 in FIG. 1.

In the present instance, the various components of the descent apparatus are mounted on a rigid frame 14 made up of a base plate 15 (FIG. 4), a parallel front plate 16, end plates 17 and 18 and cross plates 19 and 20 suitably welded and bolted together. The frame is mounted on the inside of an exterior wall 21 of the building above the window 13 in the wall and, for this purpose, the base plate 15 is secured to the wall as by screws 22 (FIG. 4). The components of the apparatus are enclosed by a cover 23 (FIGS. 1 and 2) which snaps onto the frame in any suitable manner well known in the art.

Figure 10:
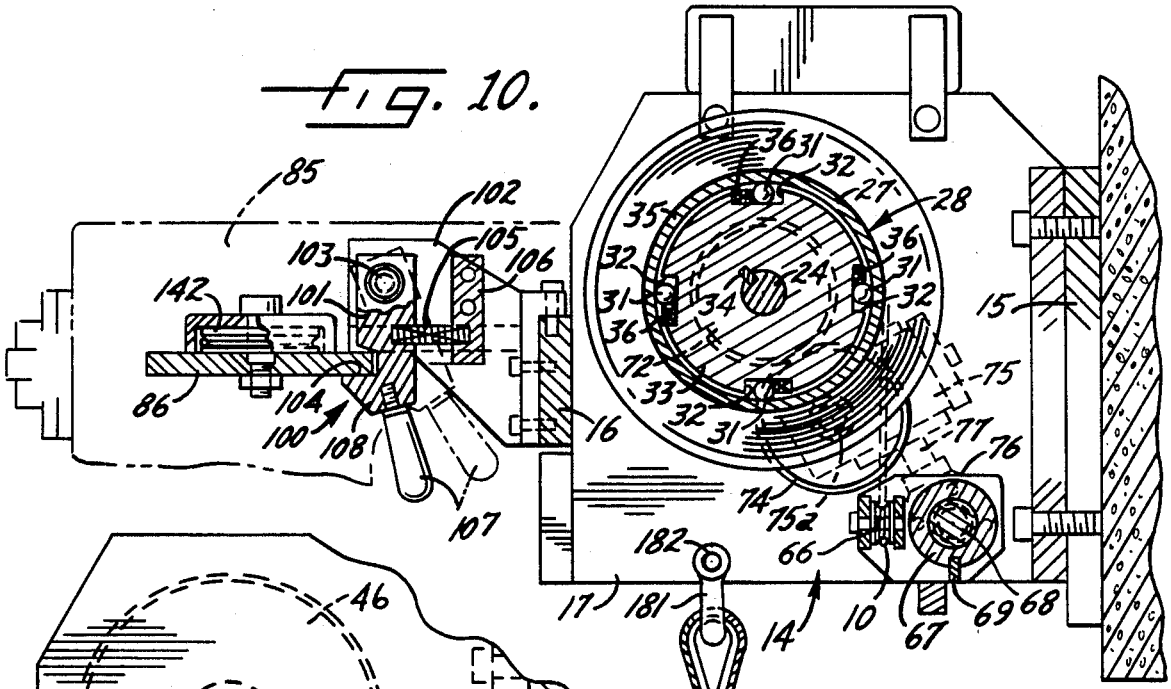
FIG. 10 is an enlarged fragmentary sectional view taken along the line 10—10 in FIG. 4.

The drum 11 is coaxial with and carried by a horizontal shaft 24 (see FIG. 4) which has its ends journaled in the cross plate 20 and the end plate 18 of the frame 14. The drum is journaled on the shaft by means of the cylindrical driven member 25 (FIG. 4) of a rewind clutch 26 and the cylindrical drive member 27 of a one-way clutch 28, the clutch members 25 and 27 being pressed into the opposite ends of the drum and turning respectively on bearing sleeves 29 and 30 which are fast on the shaft. When the drum is being turned in the direction caused by the cable 10 unwinding during a descent, clockwise in FIG. 10, the drum turns the shaft 24 through the clutch 28 but the latter causes the shaft to be disengaged from the drum when the drum is turned in the opposite direction to rewind the cable. Herein, the clutch 28 is the grip-roller free wheeling type with rollers 31 (FIG. 10) received in circumferential slots 32 in the driven member 33 of the clutch. The driven member is keyed at 34 to the shaft 24 and is disposed within an annular flange 35 on the drive member 21. The rollers 31 are urged in a clockwise direction by individual compression springs 36 so that, when the drum and the flange 35 are turned in the clockwise direction, the rollers wedge against the interior of the flange whereby the driven member 33 and the shaft 24 turn with the drum. When the drum is turned in the opposite direction, however, the rollers compress the springs and release the flange so that the drum turns freely on the shaft.

Figure 11:
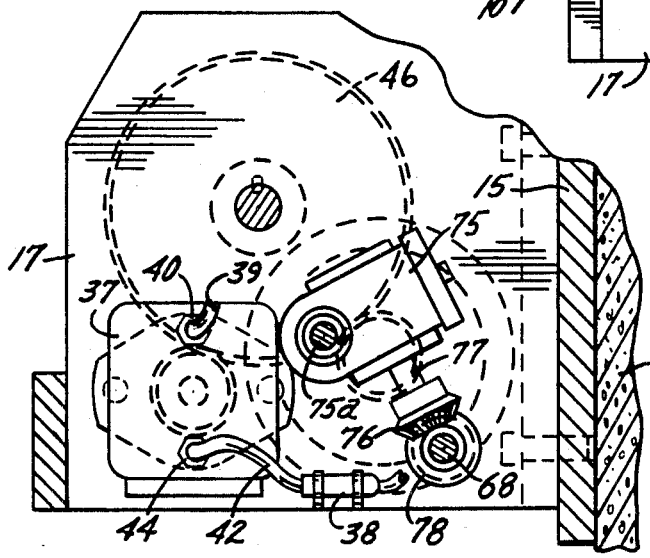
FIG. 11 is an enlarged fragmentary sectional view taken along the line 11—11 in FIG. 4.

In the preferred embodiment, the control means for the speed of rotation of the drum 11 in the unwinding direction includes a positive displacement pump 37 (FIGS. 4, 5 and 11) driven by the shaft 24 and a flow control valve 38 (FIG. 11) which restricts the flow of the output of the pump. Herein, the pump is a piston pump bolted to the cross plate 19 and a hydraulic fluid such as oil is delivered through a hose 39 to the inlet 40 of the pump from a reservoir or tank 41 mounted on the frame 14. The valve 38 is interposed in a hose 42 (FIG. 11) between a filter 43 (FIG. 1) and the outlet 44 of the pump and a return line 45 connects the filter to the tank 41. The pump is driven by the shaft 24 through a spur gear 46 (FIGS. 4 and 5) keyed to the shaft and meshing with a gear 47 fast on the shaft of the pump. The valve may be manufactured to permit the flow which produces the selected maximum rate of descent or it may be adjustable but, once set, it usually is left at the desired setting. Because the piston pump operates at a constant speed for a constant flow, the valve effectively limits the speed of the pump and hence the speed of rotation of the drum.

Figure 9:
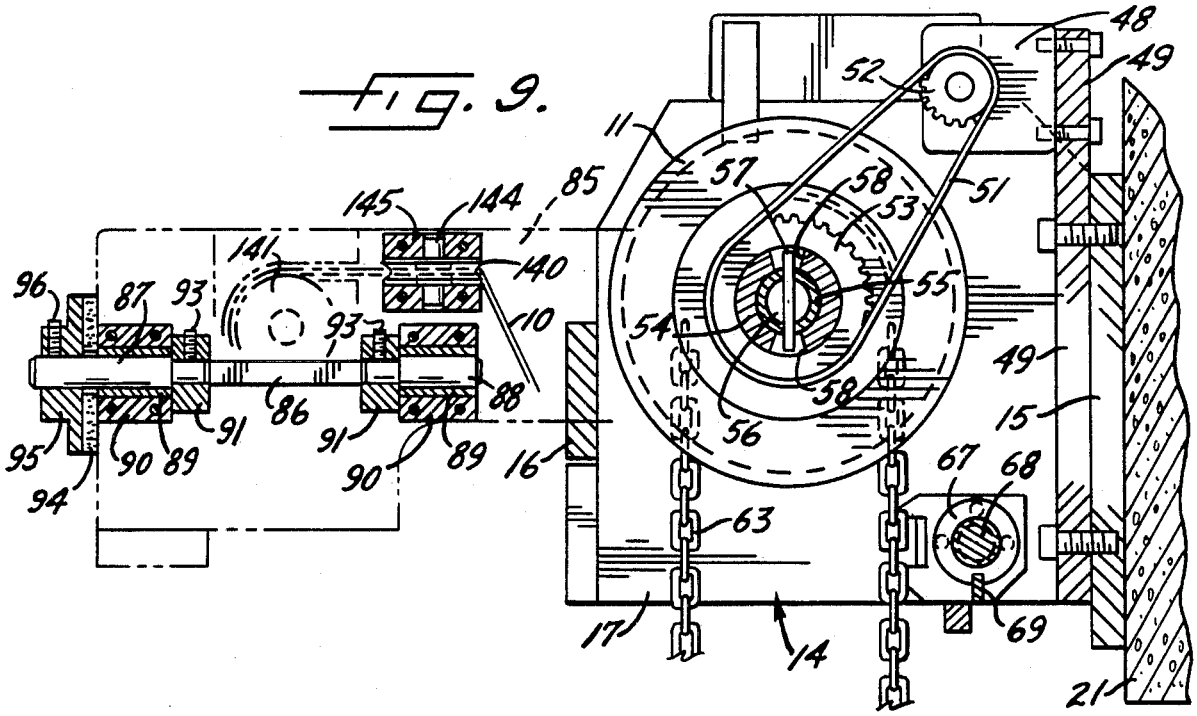
FIG. 9 is an enlarged sectional view taken along the line 9—9 in FIG. 4.

After a descent, the cable 10 may be rewound on the drum 11 for a second descent and such rewinding may be accomplished by power if power is available under the circumstances but otherwise by hand. For this purpose, an electric motor 48 (FIGS. 4, 5 and 9) mounted on a vertical plate 49 of the frame 14 is coupled to the drive member 50 of the rewind clutch 26 through a chain 51 trained around a sprocket 52 keyed to the shaft of the motor and around a second sprocket 53 fast on the drive member. As shown in Fig. 9, the drive member and the sprocket 53 are rotatably and slidably mounted on a bearing sleeve 54 which, in turn, is rotatable on a sleeve 55 pressed onto the reduced end portion 56 of the shaft 24. A pin 57 extends diametrically through the end portion 56 and the sleeve 55 and into cam slots 58 in the bearing sleeve 54 and, as illustrated in FIG. 4, the slots are inclined to the transverse. Thus, as the sprocket 53 is turned by the chain 51, friction causes the bearing sleeve 54 to turn on the sleeve 55 and, inasmuch as the sprocket is being turned in the rewinding direction (opposite to the arrow in FIG. 4), the edges of the slots 58 move along the pin 57 and cam the sleeve 54 and the drive member 50 axially toward the driven member 25 against the action of a compression spring 59. The latter encircles the drum shaft 24 and acts between the drive and driven members. Axially facing teeth 60 on the drive member thereby engage opposing and mating teeth 61 on the driven member. When the ends of the cam slots engage the pin, the drive member 50 turns on the bearing sleeve 54 and thus the motor 48 drives the drum 11 in the rewind direction through the chain 51 and the clutch 26. The motor is energized by means of a push button switch 62 (FIG. 3) which may conveniently be mounted on the arm 12 and the motor is stopped by means of a microswitch 162 which, as will be described later, is opened by the cable 10. If power is not available for the motor, the drum may be rewound manually by an endless chain 63 entrained over a wheel 64 which is rigid with the drive member 50.

Figure 5:
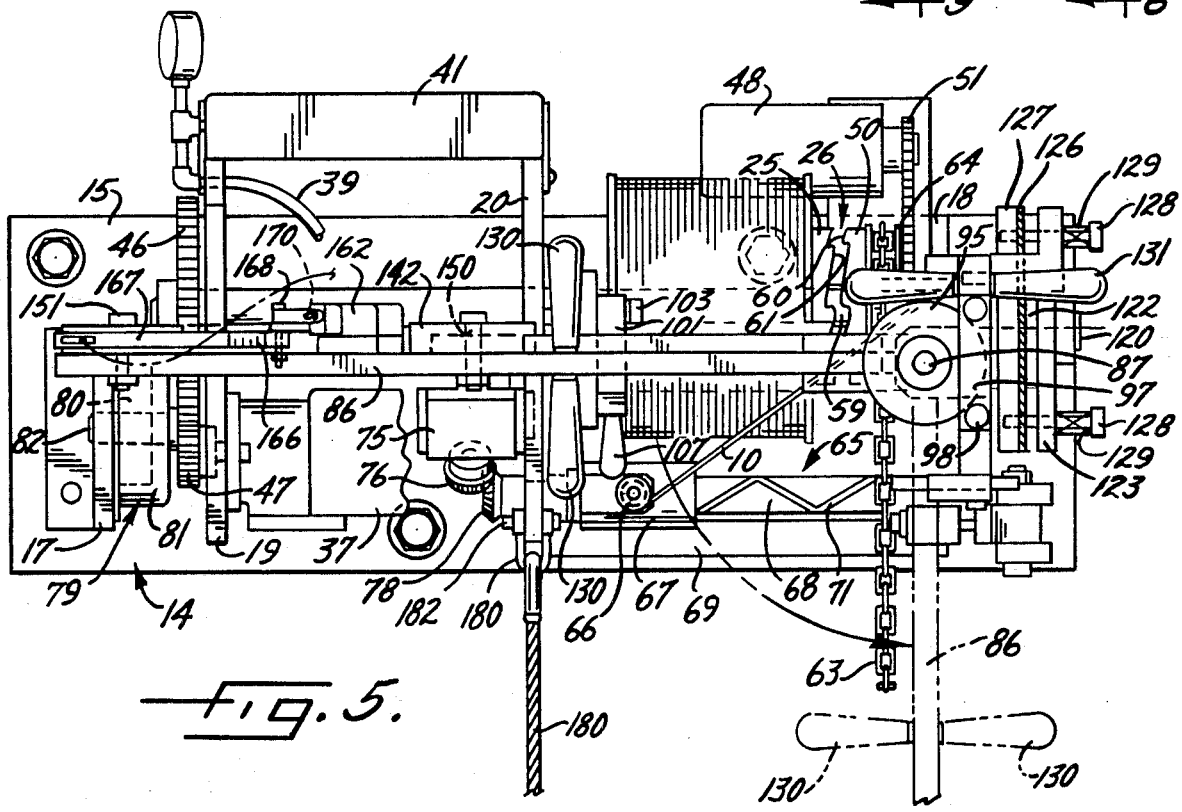
FIG. 5 is a front elevational view of the apparatus on the same scale as FIG. 4.

In order that the cable 10 is wound evenly on the drum 11, it is traversed back and forth between the ends of the drum by a conventional level winding mechanism 65 (FIG. 5). In general, this mechanism includes a small pulley 66 journaled on a nut 67 which surrounds a shaft 68. The latter parallels the shaft 24 and is journaled on the frame 14 in the cross plate 20 and the end plate 18. As is customary with mechanisms of this type, the shaft 68 is turned while the nut 67 is held against turning by a stationary bar 69 which is parallel to the shaft and which is received in a longitudinal slot 70 in the nut. A follower (not shown) on the inside of the nut rides in a diamond shaped track 71 in the shaft so that the nut travels along the shaft and reverses direction each time it reaches an end of the shaft. As a result, the cable which passes around the pulley 66 before being wound on the drum, moves back and forth between the ends of the drum and the cable thereby is evenly distributed. To turn the shaft 68, a spur gear 72 (FIG. 4) is fast on a sleeve 73 which is journaled on the shaft 24 and is fixed to the drum 11 so that the sleeve and hence the shaft turn with the drum. The gear 72 meshes with another spur gear 74 which is keyed to the input shaft 75*a* of a gear box 75 (see also FIGS. 10 and 11). A bevel gear 76 fast on the output shaft 77 of the gear box meshes with a bevel gear 78 fixed to one end of the screw shaft 67 so that the latter turns in both directions with the drum 11 as the cable 10 is wound and unwound.

The invention also contemplates the provision of friction means which limits the turning of the drum 11 and hence the descent to a speed or rate somewhat higher than the rate produced by the flow control valve 38 with the friction means automatically taking control in the unlikely event that the primary system of the valve and the pump 37 fails. While this friction means may take various forms, it is preferred to use a conventional centrifugal friction brake 79 (FIG. 4) which, in the present apparatus, has a stationary member 80 and a drive member 81 driven by the drum. The drive member 81 is disposed between the end plate 17 and the cross plate 19 and its shaft 82 is journaled in these two plates and parallels the drum shaft 24. The spur gear 46 keyed to the drum shaft meshes with a spur gear 83 fast on the brake shaft so that the drive member 81 is driven by the drum 11 through the shaft 24 as the cable 10 is unwound. When the speed of the drum shaft is at or below that permitted by the flow control valve, the centrifugal force at the brake is not sufficient for engagement. If, however, the speed of the drum shaft increases beyond that limit, the centrifugal force at the brake reaches a point where it causes engagement of the drive and stationary members 81 and 80 and produces a frictional braking action which limits the descent to a safe speed although a speed somewhat higher than the speed permitted by the flow control valve.

In accordance with another aspect of the invention, the arm 12 is constructed in a novel manner so as to be readily and compactly stored on the frame 14 within the cover 23 and still be easily projected through an opening in the wall 21 such as the window 13 so that it is in its active position to guide the cable 10 for a descent. Moreover, the arm is constructed so that the arm will break any pane 84 of glass that may be in the window as the arm moves to its active position. In its more detailed aspects, the invention contemplates an arm which has a stored condition, which may be quickly placed in its operative but inactive position and which is easily swung to its active position. To these ends, the arm is made up of an inner section 85 fulcrumed at one end to the frame 14 to swing about a horizontal axis parallel to the wall 21. The arm also includes an outer section 86 which has one end pivotally connected to the outer end of the section 85 to swing about an axis which extends longitudinally of the inner section. Thus, when the arm is stored, both sections are inside the cover with the inner section 85 horizontal and perpendicular to the wall and the outer section 86 horizontal and perpendicular to the inner section. The outer arm is swung down and locked as an extension of the inner section to place the arm in the inactive or preparatory position (see FIG. 1). Then, the two sections are swung as a unit about the pivotal axis of the inner section to project the free end of the outer section through the window (FIGS. 2 and 3) and this is the active position of the arm. At all times, the cable 10 is guided along the arm from the drum 11 to the free end of the outer section so that the cable is immediately ready for a descent.

Figures 6, 7, 8:
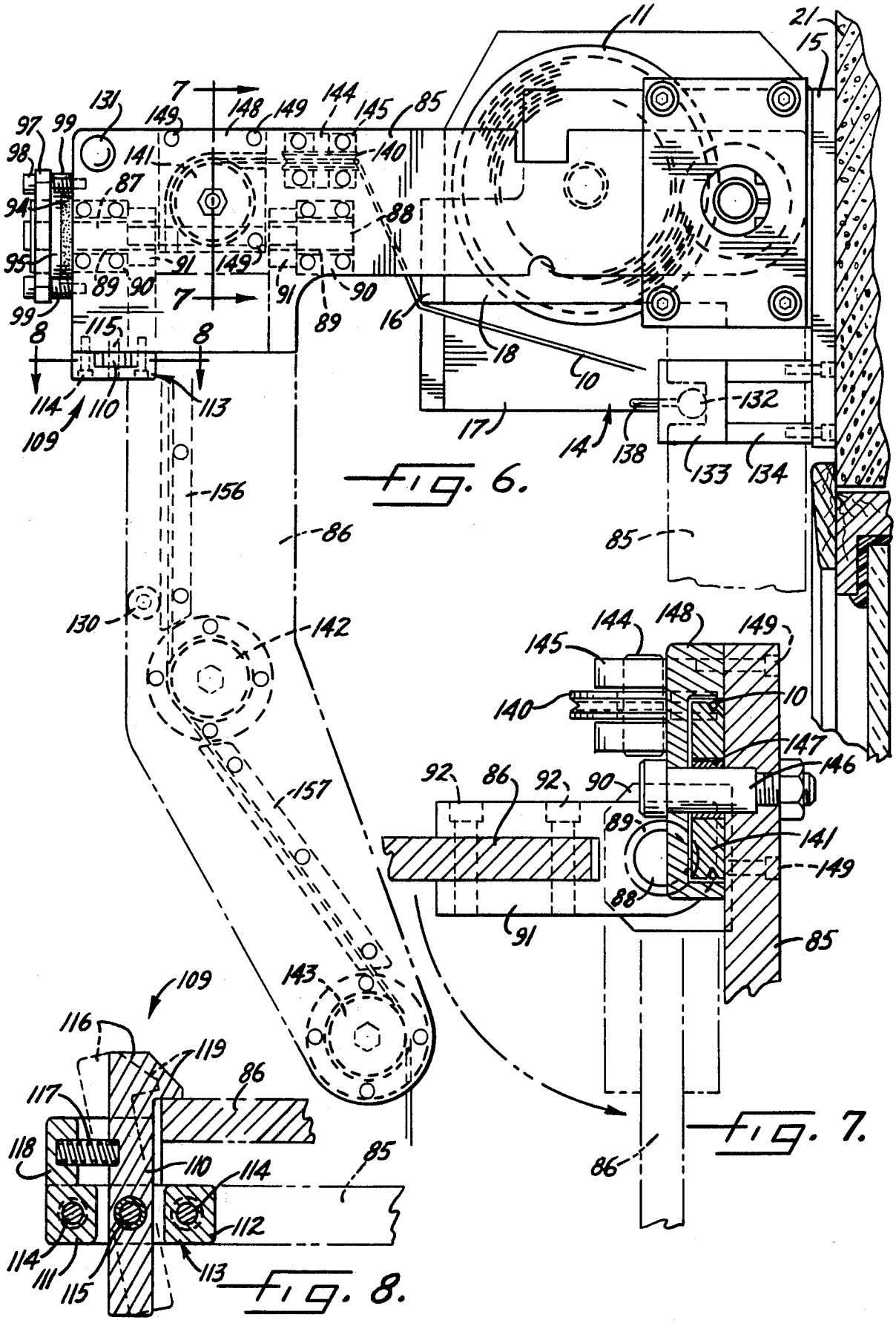
FIG. 6 is an end view as seen along the line 6—6 in FIG. 4.
FIG. 7 is an enlarged fragmentary sectional view taken along the line 7—7 in FIG. 6.
FIG. 8 is an enlarged fragmentary sectional view taken along the line 8—8 in FIG. 6.

In the present instance, as illustrated in FIGS. 4, 6 and 9, the pivotal connection of the outer section 86 to the inner section 85 includes two alined and axially spaced pins 87 and 88 journaled in individual cylindrical bearings 89 which are mounted in brackets 90 bolted to the side of the inner arm adjacent the outer end thereof. The adjacent end portions of the pins are reduced in diameter and received in parallel bifurcated plates 91 which straddle the adjacent end of the outer section and are secured to the latter by bolts 92 (FIG. 7), the pins being secured in the plates by set screws 93 (FIG. 9). Thus, the outer section can swing about the pins from the horizontal stored position shown in solid lines in FIG. 1 through a right angle to the vertical or operative position illustrated in broken lines. To prevent the outer section from swinging down too rapidly and possibly injuring someone, a friction pad 94 (FIGS. 4 through 6 and 9) concentric with the pin 87 bears against the outer edge of this section. Herein, the pad is circular and made of brass and is bonded to a cylindrical backing member 95 which, with the pad, is received on an extension of the pin 87 and held in place by a set screw 96 (FIG. 9). A bar 97 (FIG. 6) extends the backing member and bolts 98 project through the bar and are threaded into the inner section 85 of the arm 12. Coiled compression springs 99 encircle the bolts and act between the backing member and the inner section and the bolts are tightened against the action of these springs to selectively increase the force with which the pad bears against the inner section.

A latch 100 (FIGS. 4 and 10) releasably holds the outer section 86 of the arm 12 in its horizontal stored position and, in this instance, the latch is in the form of a vertical rectangular plate 101 pivotally mounted on a bracket 102 at 103 (FIG. 10) to swing about an axis which parallels the outer section when the latter is in the stored position, the bracket being bolted to the front plate 16 of the frame 14. The latch plate 101 is disposed along the inside edge of the section 86 which is received in a notch 104 in the latch plate so as to be held in the stored position. A compression spring 105 acts between a block 106 on the bracket 102 and the back of the latch plate and urges the latter toward the latched position. To release the outer arm section, the latch plate is swung back against the action of the spring, a handle 107 being mounted on the lower end of the latch plate for this purpose. When the section 86 is returned to the stored position, the section engages an inclined surface 108 on the latch plate and cams the latter back until the section is even with the notch 104 at which time the plate swings forward to hold the section.

Another latch 109 (FIGS. 6 and 8) secures the outer section 86 of the arm 12 when this section is in the operative position as an extension of the inner section 85. Herein, this latch is a finger 110 disposed between the legs 111 and 112 of a U-shaped bracket 113 which is secured to one edge of the inner bracket by bolts 114. Adjacent one end, the finger is pivoted on the inner section and the bracket by a pin 115 and the other end is formed as a hook 116 which engages and holds the outer section in place. The finger 110 is urged toward its latching position by a coiled compression spring 117 acting between the back of the finger and a wall 118 of the bracket. As the outer section approaches its operative position, it engages an inclined surface 119 on the hook end of the finger and cams the latter back against the action of the spring 117 until the outer end passes the hook. The finger is swung manually to release the outer section when it is desired to return this section to the stored position.

To support the inner section 85 of the arm 12 for swinging about its horizontal axis, the end portion of the section adjacent the wall 21 is fast on a fixed stub shaft 120 (FIGS. 4 and 5) which is mounted on the end plate 18 of the frame 14. Friction is applied to the inner section to the extent necessary to hold the two arm sections 85 and 86 in the inactive or ready position, shown in solid lines in FIG. 2, until the arm is manually swung to the active position. Herein, such friction is applied by an assembly which includes a brass sleeve 121 rotatable on the stub shaft with one end pressed into a hole in the inner arm section and with a radial flange 122 formed on the other end. A steel plate 123 is received on the stub shaft outside the flange 122 and is captured on the shaft by a split brass collar 124 which is clamped on the shaft by a bolt 125 (see FIG. 12). Encircling the sleeve 121 inside the flange is a second steel disk 126 which is brazed to a brass ring 127 also encircling the sleeve. A plurality of bolts 128 project through the steel plate 123 and the steel disk 126 and are threaded into the brass ring 127 and compression springs 129 surrounding the bolts act between the plate 123 and the heads of the bolts so that the steel disk and the steel plate are yieldably pressed against the flange 122. The steel plate and the steel disk are connected to the frame 14 in any suitable manner so that they do not turn and, as a result, they act through the flange to apply the desired frictional drag to the inner arm section 85.

Figure 3:
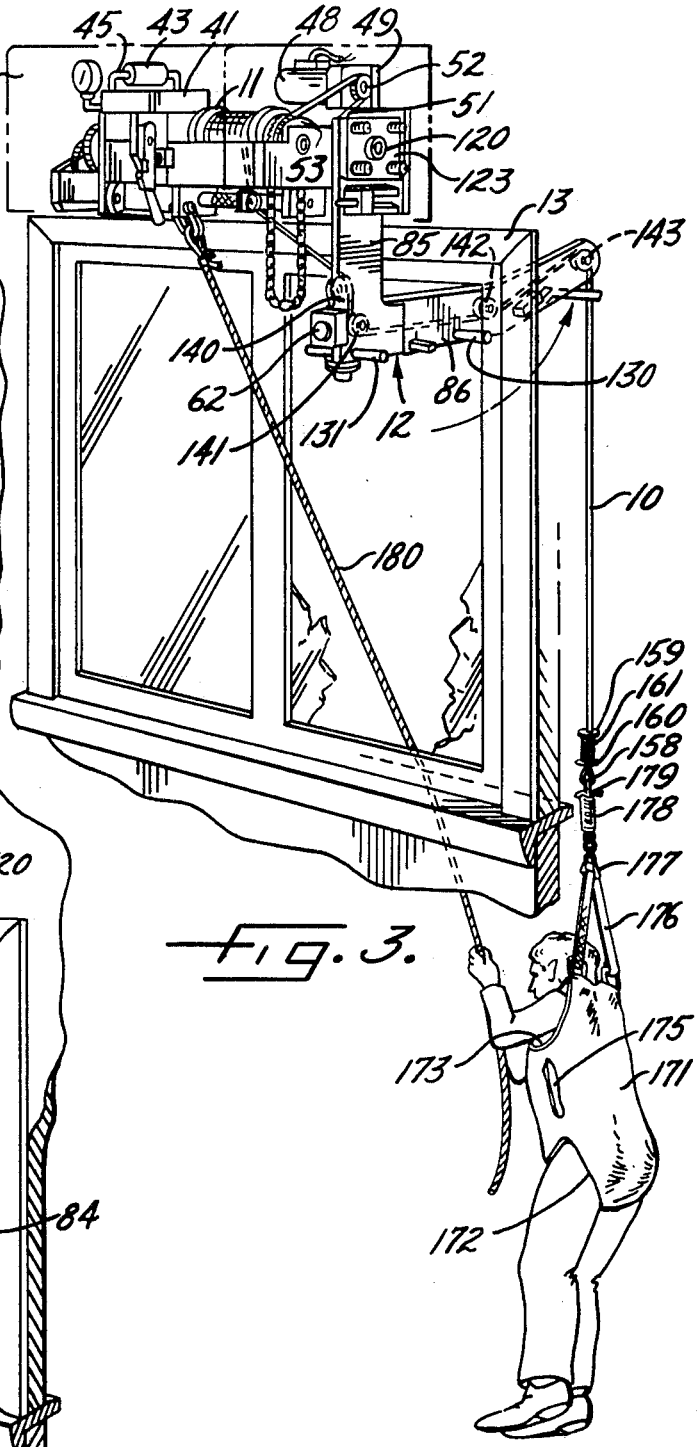
FIG. 3 is a view similar to FIG. 1 but showing the parts in a still further moved position.
Figures 12, 13:
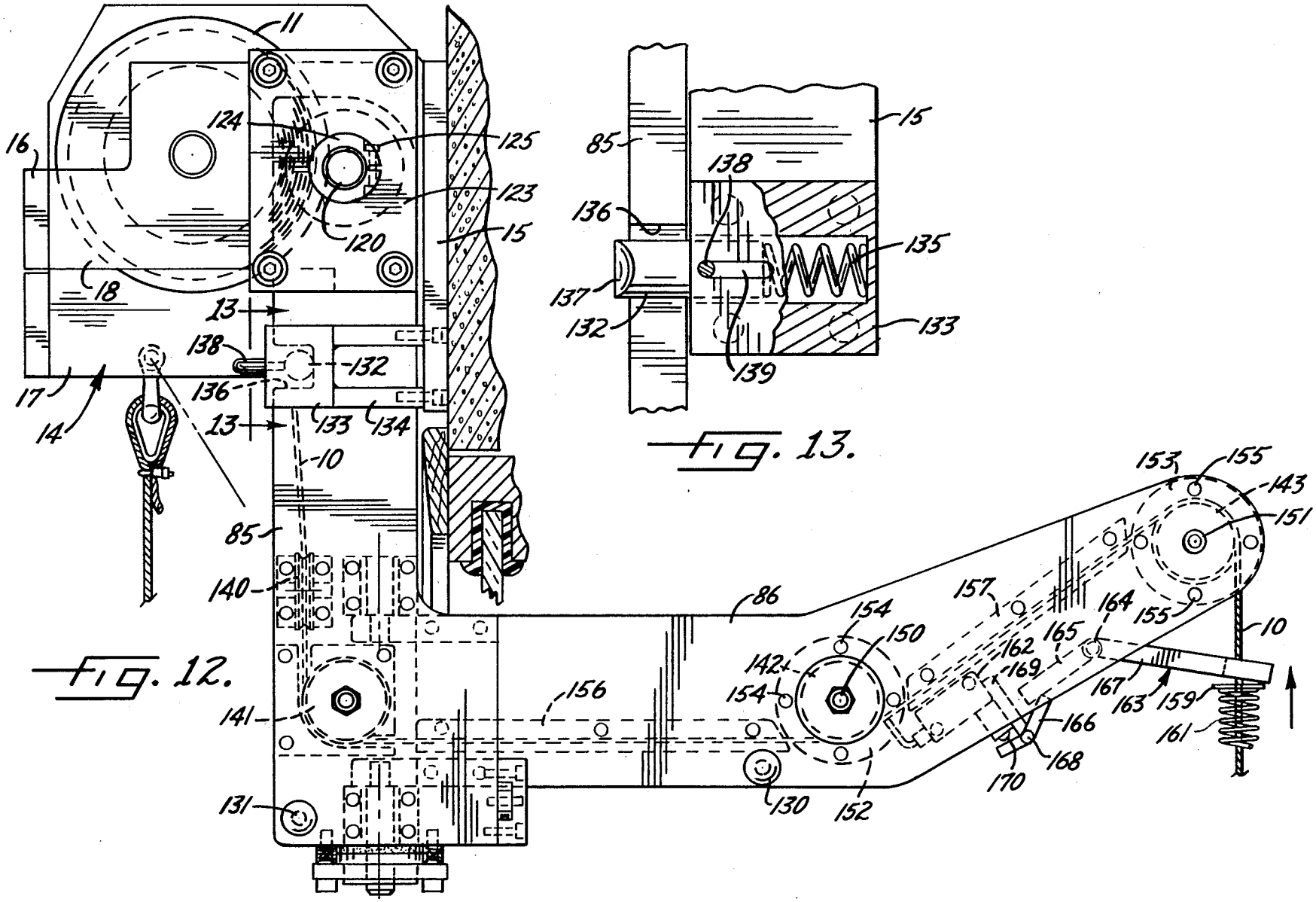
FIG. 12 is a side view similar to FIG. 6 but showing the parts in a moved position.
FIG. 13 is a sectional view taken along the line 13—13 in FIG. 12.

With the outer arm section 86 down in the operative or ready position, the entire arm 12 is swung as a unitary assembly about the stub shaft 120 to the active position, illustrated in FIG. 3, in which the outer section projects through the window 13 to the outside of the wall 21. If the pane 84 is still in the window at the time, the arm breaks the pane as it swings to the active position (see FIG. 2). Such swinging is accomplished manually and, for this purpose, the user grasps a pair of handles 130 fixed to and projecting from the sides of the outer arm section. An alternate pair of handles 131 are similarly mounted on the inner section 85 and the user may grasp whichever pair of handles is more convenient for him. When the arm reaches the active position, it is latched in that position by a slidable bolt 132 (FIGS. 12 and 13). The latter slides in a housing 133 which is mounted on a bracket 134 bolted to the back plate 15 of the frame 12 and the bolt slides in a direction perpendicular to the inner arm section 85. The bolt is urged outwardly by a compression spring 135 acting between the bolt and the back of the housing and, when the arm is in the active position, the bolt projects into a hole 136 in the inner section and latches the arm in place. The outer end portion of the bolt is chamfered as indicated at 137 so that the inner section engages this end portion and cams the bolt back to the retracted position as an incident to the swinging of the arm to the active position. When the arm reaches that position, the bolt snaps into the hole 136 under the action of the spring 135. In order to return the arm to the stored position, the bolt is retracted manually by means of a pin 138 secured to the bolt and projecting through a longitudinal slot 139 in the housing.

The cable 10 is guided from the drum 11 to the free end of the outer arm section 86 in all conditions and positions of the arm 12 so that the cable is ready for a descent as soon as the arm reaches its active position. For this purpose, the cable is passed over, in order, pulleys 140 and 141 on the inner arm section 85 and pulleys 142 and 143 on the outer arm section 86. The pulley 140 is in a plane perpendicular to the inner arm section and is journaled on a pin 144 (FIGS. 4, 6, 7 and 9) which is mounted in a bracket 145 bolted to the inner section and extends longitudinally of the latter. The next pulley 141 guides the cable through a right angle turn and, accordingly, it is in a plane parallel to the inner arm section (see FIGS. 4, 6 and 7) and is journaled on a bolt 146 by means of a bearing sleeve 147 adjacent the pivotal connection to the outer section. The bolt passes through a bracket 148 and the inner arm section so that it clamps the bracket to the inner section and the bracket also is fastened to the inner section by bolts 149 to provide transverse support to the head end of the bolt. The pulleys 142 and 143 are similarly mounted on the outer arm section alongside the latter by means, respectively, of center bolts 150 and 151, brackets 152 and 153 and bolts 154 and 155. The pulley 142 is intermediate the ends of the outer section and the pulley 143 is adjacent the free end of the latter. As shown in FIGS. 4, 6 and 12, a trough 156 is bolted to the outer section to guide the cable from the pulley 141 to the pulley 142 and a second trough 157 is bolted to this section to guide the cable from the pulley 142 to the pulley 143.

The free end of the cable 10 terminates in a loop 158 (see FIGS. 3 and 4) and carries spaced washers 159 and 160 separated by a compression spring 161. The washer 159 is effective to open a switch 162 in the circuit of the rewind motor 48 when the cable has been fully rewound on the drum 11 and, for this purpose, the switch is normally closed and is fastened to the side of the outer arm section 86 to be actuated by a lever 163. The latter is fulcrumed on the outer section by a pin 164 with one arm 165 of the lever engaging a reversing lever 166 and the arm 167 projecting in under the pulley 143 at the free end of the outer arm section, the cable passing through the latter arm. The reversing lever is fulcrumed at 168 on a bracket 169 fixed to the outer arm section and is engageable with the actuator 170 of the switch to open the latter. As the cable approaches its fully wound condition, the washer 159 engages the arm 167 to turn the lever 163 counterclockwise as viewed in FIG. 12 and this turns the lever 166 clockwise to open the switch, the spring 161 permitting the washer to yield somewhat during this engagement and permitting slight overtravel of the cable.

A sling or garment 171 is attached to the free end of the cable 10 to securely hold a person while being lowered by the apparatus. In the present instance, the garment receives the entire torso of the person and is made with leg holes 172 (FIG. 2) and arm holes 173 with the front being closed by buttons or snaps 174. The arm holes 173 are located to accommodate adults and, preferably, a second and lower pair of arm holes 175 are provided for children. A strap 176 is securely fastened to the shoulders of the garment and is passed through an eye 177 (FIG. 3) on the lower end of a shock absorber 178, the eye 179 on the upper end of the latter being connected to the loop 158 on the end of the cable. As shown in FIG. 1, the garment rests on the inside of the cover 23 when the parts are in the stored condition and drops down where it is accessible when the cover is opened (see FIG. 2). When the user has donned the garment, he steps through the window 13 preparatory to the descent and, to steady him in this, a rope 180 (FIGS. 3, 5 and 11) is hung from the cross plate 17 of the frame 14 by means of a clevis 181 and a pin 182. The rope is stored with the garment and also drops down when the cover is opened.

Figure 2:
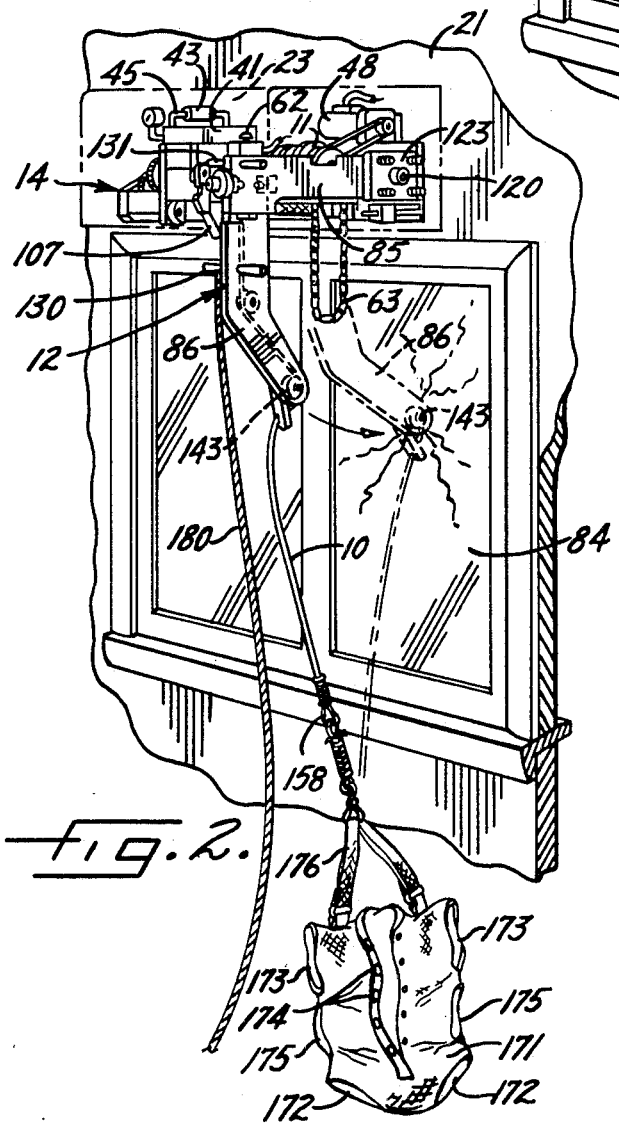
FIG. 2 is a view similar to FIG. 1 but showing the parts in moved position.

When the descent apparatus is to be used, the handle 107 on the lever 101 is pushed to release the outer arm section 86 which thus swings down to its ready position shown in FIG. 2 and is held in that position relative to the inner arm section 85 by the latch 109. As the outer arm section swings down, the garment 171 and the rope 180 drop down to where they are accessible to the user. Employing either the handle 130 or the handles 131, the user then swings the arm 12 about the stub shaft 120 so that the arm breaks through the window pane 84 on its way to its active position (FIG. 3) in which the outer section projects through the window 13. The bolt 132 (FIG. 12) retracts and then springs out and into the hole 136 in the inner section to hold the arm in this position. The user then puts on the garment and steps through the window while holding the rope. As soon as the rope is released, the person begins to descend, unwinding the cable 10 from the drum 11 by virtue of his own weight. As the drum turns during this unwinding, it drives the pump 37 through the shaft 24 and the gears 46 and 47. Because the rate of flow of hydraulic fluid through the outlet 44 of the pump is limited by the flow control valve 38 to a preset maximum, the shaft 24 and hence the drum 11 also are limited to a corresponding speed. As a result, the person descends at a maximum rate correlated with the setting of the flow control valve. In practice, a descent at the rate of five feet per second has been found to be desirable. In the unlikely event that the valve fails to limit the speed of descent, the drum and the shaft will turn faster until they reach the speed at which the centrifugal brake 79 becomes effective and the descent then continues at a controlled but somewhat faster rate. A rate of ten feet per second is suitable for descent under the control of the brake.

If, after the descent has been completed, it is desirable to lower another person, the push button switch 62 is closed to energize the rewind motor 48 which turns the drum 11 through the rewind clutch 26 to wind the cable 10 onto the drum. Because the main clutch 28 does not transmit in this direction, however, the pump 37 is not driven. During rewinding, the nut 67 (FIG. 5) travels back and forth along the shaft 68 so that the cable is wound evenly on the drum. As the garment 171 approaches the arm 12, the washer 159 engages and lifts the arm 167 of the lever 163 (FIG. 4) to open the switch 162 and deenergize the rewind motor 48. The garment 171 and the rope 180 then are pulled inside through the window 13 where they are ready for the second person. If power is not available for the rewind motor 48, the chain 63 is used to turn the drum and rewind the cable.

I claim:

1. Controlled descent apparatus having, in combination, a stationary frame adapted to be mounted on the inside of an exterior wall of a building adjacent an opening in the wall, an arm made up of an inner section and an outer section, means on said frame supporting said inner section at one end thereof to swing about a horizontal axis parallel to said wall, said inner section swinging from an inactive position perpendicular to the wall to an active position parallel to the wall, said outer section being pivotally connected at one end to the other end of said inner section to swing on the latter from a stored position to a ready position when the inner section is in said inactive position, said outer section being horizontal and projecting laterally from said inner section when in said stored position and projecting generally vertically downwardly from the inner section when in said ready position, means operable when said outer section is in said ready position to latch the outer section to said inner section, means operable when said inner section is in said active position to latch the inner section to said frame, the free end of said outer section projecting through said opening when said inner section is in said active position, a supply of cable stored on said frame, a pulley mounted on said outer section adjacent said free end thereof, means for guiding an end portion of said cable from said supply and over said pulley whereby a weight attached to the cable beyond the pulley will descend while drawing cable from the supply, and mechanism mounted on said frame and operable to control the rate at which said cable is drawn from said supply whereby the weight descends at a controlled rate.

2. Controlled descent apparatus as defined in claim 1 further including a drum journaled on said frame and storing said supply, said mechanism comprising a shaft driven by said drum, a positive displacement pump mounted on said frame and having an inlet and an outlet, a reservoir of hydraulic fluid connected to said inlet whereby said pump delivers fluid to said outlet, a flow control valve connected to said outlet to limit flow of fluid through said outlet to a preselected volume thereby to limit said pump to a preselected speed, a first drive train connecting said shaft to said pump to drive the pump from said drum whereby the speed at which the drum turns and the rate of descent of said object are limited by said preselected speed of the pump, a centrifugally responsive friction brake, and a second drive train connecting said shaft and said brake, said brake engaging when said drum and said shaft turn at a second preselected speed faster than permitted by said valve and thereafter limiting the descent of said object at a higher rate.

3. Controlled descent apparatus as defined in claim 1 including a second pulley mounted on said inner section, said cable being trained over said second pulley and then over the pulley on said outer arm, said means for guiding the end portion of said cable including said second pulley and being operable in all positions of said inner and outer sections.

4. Controlled descent apparatus as defined in claim 3 in which said supply of cable includes a drum journaled on said frame with the cable wound on the drum.

5. Controlled descent apparatus as defined in claim 1 further including a drum journaled on said frame and storing said supply, said mechanism comprising a positive displacement pump mounted on said frame and having an inlet and an outlet, a reservoir of hydraulic fluid connected to said inlet whereby said pump delivers fluid to said outlet, a flow control valve connected to said outlet to limit flow of fluid through said outlet to a preselected volume thereby to limit said pump to a preselected speed, and a drive train connecting said drum to said pump to drive the pump from the drum whereby the speed at which the drum turns and the rate of descent of said object are limited by said preselected speed of the pump.

6. Controlled descent apparatus as defined in claim 5 in which said positive displacement pump is a piston pump.

7. Controlled descent apparatus as defined in claim 5 in which said drum turns in one direction during descent and in the reverse direction to rewind said cable on the drum, said apparatus including mechanism to turn said drum in said reverse direction, and means operable automatically to disconnect said drum from said drive train when the drum is turning in the reverse direction.

8. Controlled descent apparatus as defined in claim 7 in which said means disconnecting the drum from the drive train is a one-way clutch.

9. Controlled descent apparatus as defined in claim 1 further including a drum journaled on said frame and storing said supply, said mechanism comprising a positive displacement pump mounted on said frame and having an inlet and an outlet, a reservoir of hydraulic fluid connected to said inlet whereby said pump delivers fluid to said outlet, a flow control valve connected to said outlet to limit flow of fluid through said outlet to a preselected volume thereby to limit said pump to a preselected speed, a drive train connecting said drum to said pump to drive the pump from the drum when turned in said one direction whereby the speed at which the drum turns and the rate of descent of said object are limited by said preselected speed of the pump, a clutch having a driven member connected to said drum and a driving member normally disengaged from said driven member, means for turning said driving member in a direction to turn said drum in the other direction, means responsive to turning of said driving rember to cause engagement of said driving and driven members thereby to turn said drum in said other direction and rewind the cable on the drum, and mechanism responsive to turning of said drum in said other direction and operable to disconnect said drive train from said drum whereby said pump is not driven while the cable is being rewound on the drum.

10. Controlled descent apparatus as defined in claim 9 in which said means for turning said drive member includes a power operated motor.

11. Controlled descent apparatus as defined in claim 9 in which said means for turning said drive member includes a manually operable rotary member.

12. Controlled descent apparatus as defined in claim 9 in which said means for turning said drive member includes a power operated motor and a manually operable rotary member each selectively operable to turn the drive member.

13. Controlled descent apparatus as defined in claim 9 including a one-way clutch having a drive member turned by said drum and a driven member connected to said drive train, said one-way clutch being operable to turn said driven member when said drum turns in said one direction but not in said other direction.

14. Controlled descent apparatus as defined in claim 9 including a shaft journaled on said frame and connected to said drive train, said drum being journaled on said shaft, and a one-way clutch connecting said drum and said shaft and operable to cause the shaft to turn with the drum only when the drum turns in said one direction.

* * * * *